US010793386B2

(12) United States Patent
Amen et al.

(10) Patent No.: US 10,793,386 B2
(45) Date of Patent: Oct. 6, 2020

(54) DEVICE FOR STACKING NOTES OF VALUE

(71) Applicant: Wincor Nixdorf International GmbH, Paderborn (DE)

(72) Inventors: Benedikt Amen, Brilon (DE); Elmar Berendes, Warburg (DE)

(73) Assignee: Wincor Nixdorf International GmbH, Paderborn (DE)

( * ) Notice: Subject to any disclaimer, the term of this patent is extended or adjusted under 35 U.S.C. 154(b) by 0 days.

(21) Appl. No.: 16/257,813

(22) Filed: Jan. 25, 2019

(65) Prior Publication Data

US 2019/0225449 A1 Jul. 25, 2019

(30) Foreign Application Priority Data

Jan. 25, 2018 (DE) ..... 10 2018 101 683

(51) Int. Cl.

| | |
|---|---|
| ***B65H 29/04*** | (2006.01) |
| ***B65H 29/46*** | (2006.01) |
| ***B65H 29/54*** | (2006.01) |
| ***B65H 29/28*** | (2006.01) |
| ***B65H 29/56*** | (2006.01) |
| ***B65H 29/40*** | (2006.01) |

(Continued)

(52) U.S. Cl.

CPC ..... *B65H 29/04* (2013.01); *B65H 29/001* (2013.01); *B65H 29/28* (2013.01); *B65H 29/38* (2013.01); *B65H 29/40* (2013.01); *B65H 29/46* (2013.01); *B65H 29/54* (2013.01); *B65H 29/56* (2013.01); *B65H 2404/154* (2013.01); *B65H 2404/2311* (2013.01); *B65H 2404/692* (2013.01); *B65H 2701/1912* (2013.01)

(58) Field of Classification Search

CPC ..... B65H 29/40; B65H 29/46; B65H 29/38; B65H 29/28; B65H 29/54; B65H 29/56; B65H 29/04; B65H 2404/2311

USPC ..... 271/177, 180

See application file for complete search history.

(56) References Cited

U.S. PATENT DOCUMENTS 10,580,247 B2 * 3/2020 Freitag ..... B65H 29/60

FOREIGN PATENT DOCUMENTS

DE 10147134 A1 4/2003
DE 102008039357 A1 2/2010

OTHER PUBLICATIONS

Office Action of the German Patent and Trademark Office dated Jan. 22, 2019; 4 pages.

* cited by examiner

*Primary Examiner* — David H Bollinger
(74) *Attorney, Agent, or Firm* — Black, McCuskey, Souers & Arbaugh LPA

(57) ABSTRACT

A device for stacking notes of value includes at least one circulating belt arrangement including an endless belt guided over rollers serving as deflecting elements. The circumferential surface of the belt has at least one transport tongue into which at least a section of a note of value is insertable. The device includes at least one strip-off element that contacts the note for the removal from the transport tongue. The device includes a contact element which is arranged and configured such that during the transport in the transport tongue the note moves the contact element into a first position. The contact element contacts an area of the note at least after the removal of the note of value from the transport tongue up to the arrival of this note on the deposit (Continued)

surface or on the upper note of value of a value note stack deposited on the deposit surface.

19 Claims, 7 Drawing Sheets

(51) Int. Cl.
*B65H 29/38* (2006.01)
*B65H 29/00* (2006.01)

DEVICE FOR STACKING NOTES OF VALUE

CROSS-REFERENCE TO RELATED APPLICATIONS

This application claims priority to and the benefit of German Patent Application DE 10 2018 101 683.2 filed 25 Jan. 2018, the contents of which are hereby incorporated by reference in their entirety.

BACKGROUND AND SUMMARY

This relates to a device for stacking notes of value, with at least one circulating belt arrangement including an endless belt guided over rollers serving as deflecting elements. On its circumferential surface, the belt has at least one transport tongue into which at least a section of a note of value is insertable. Further, the device includes at least one strip-off element contacting the note of value for the removal from the transport tongue so that, after the removal from the transport tongue, the note of value moves in a deposit direction until it reaches a deposit surface or until it reaches the upper note of value of a value note stack present on the deposit surface.

A large number of stacking arrangements for notes of value is known, in which stacking belts are used. From document DE 10 2008 039 357 A1, for example, a device for stacking notes of value is known, which has a circulating stacking belt. The stacking belt includes a belt body and a pair of tongues provided on the belt body and including at least one transport tongue and at least one press-on tongue for generating a press-on force during the transport of the note of value. In the known solutions, however, after removal from the transport tongues, the notes of value move in an uncontrolled manner in free fall onto an already deposited value note stack or onto a deposit element so that a disorderly value note stack is formed.

In least one embodiment, a device for stacking notes of value reliably and orderly stacks of notes of value.

According to at least one embodiment, the device includes a contact element which is arranged and configured such that during the transport in the transport tongue the note of value moves the contact element into a first position. The contact element contacts an area of the note of value at least after the removal of the note of value from the transport tongue up to the arrival of this note of value on the deposit surface or on the upper note of value of a value note stack deposited on the deposit surface. As a result, it is achieved that, after the removal from the transport tongue, up to the arrival on the deposit surface or on the upper note of value of the value note stack the note of value does not move in an uncontrolled manner in free fall but is accompanied in its movement in deposit direction and thereafter is deposited in a controlled manner.

It is advantageous when, after the removal of the note of value from the transport tongue, up to the arrival of the note of value on the deposit surface or on the upper note of value of the value note stack, the contact element and the note of value move in deposit direction with the aid of gravity. As a result, thereof, actuators can be dispensed with, as a result whereof the error proneness is reduced, and installation space is saved.

Further, it is advantageous when the contact element is pivotably mounted about an axis of rotation and when the contact element is pivotable, for example, by an angle between 5° and 30°, preferably 20°, from the first position in the deposit direction and opposite to the deposit direction.

This guarantees that, after the removal from the transport tongue, the note of value is reliably contacted by the contact element up to the deposit on the deposit surface or on the upper note of value of the value note stack deposited on the deposit surface.

In an advantageous embodiment, the contact element includes at least one friction element, the friction element being configured and arranged such that the friction element contacts the note of value when the note of value removed from the transport tongue moves in deposit direction and the contact element is pivoted by an angle between 0.5° and 3°, in particular by 1°, in deposit direction. As a result, it is achieved that the note of value does not contact the friction element when the contact element is in the first position so that the note of value is not slowed down or stopped in its transport movement by the friction element. Further, it is achieved that the note of value is pressed against the notes of value already deposited as a value note stack or against the deposit elements beyond its own weight without adhering or sticking to the contact element.

It is particularly advantageous when the contact element includes at least one sliding element, for example, a longitudinal rib. As a result, it is achieved that by the contact element the note of value is not hindered in its movement, in particular can easily slide along the contact element and does not adhere to the contact element.

Further, it is advantageous when the deposit surface includes a first deposit element and a second deposit element, on which the note of value or the value note stack rests, each of the deposit elements being pivotable about an axis of rotation parallel to its longitudinal axis. As a result, a particularly simple and cost-efficient structure of the device is made possible.

In at least one an advantageous embodiment, the notes of value can be deposited on the first deposit element and on the second deposit element whenever these are in a non-pivoted deposit position. The distance between the transport tongues and the non-pivoted deposit elements or the transport tongues and the notes of value deposited on the first deposit element and the second deposit element further defines a free space. As a result, it is achieved that a limited number of notes of value can be deposited, i.e. stacked, between the deposit elements and the transport tongues.

It is advantageous when the device has at least one control unit and at least a first sensor unit, where the first sensor unit outputs a first sensor signal dependent on the position of the contact element and when a feeding of the note of value into the device is at least not possible whenever the contact element is in the first position. Thus, value note jams are prevented and the error-proneness of the device is reduced.

It is particularly advantageous when the first sensor unit includes a first detecting element, where the first detecting element generates the first sensor signal and transfers it to the control unit. The first detecting element is for example a light barrier or a double light barrier. Thus, an accurate detection of the contact element with the aid of the first sensor unit can be accomplished.

Further, it is advantageous when the device has at least a second sensor unit including a second detecting element, where the second sensor unit outputs a second sensor signal when the second detecting element detects an edge of the note of value in a feeding area of the device. Thus, a reliable detection of the feeding of a note of value into the device can be accomplished.

In an advantageous embodiment, the device includes at least one press-on element, a drive unit for driving the press-on element being controllable with the aid of the control unit such that the drive unit moves the press-on element in the deposit direction. As a result, the value note stack is pressed together and thus compressed so that the value note storage capacity in the device is increased.

It is particularly advantageous when the contact element is connected to the press-on element so as to be pivotable about an axis of rotation. As a result, a particularly simple and cost-efficient structure of the device is made possible.

In an advantageous embodiment, the control unit determines, based on the first sensor signal and the second sensor signal, whether notes of value can be stacked in the free space. Further, the control unit moves the press-on element by a predetermined distance in the deposit direction, as soon as it determines based on the first sensor signal and/or the second sensor signal that no further notes of value can be stacked in the free space. As a result, a particularly reliable and orderly deposit of the notes of value in the form of a value note stack is achieved in the storage area.

Further, it is advantageous when during the movement of the press-on element in the deposit direction the notes of value pivot the deposit elements about their axes of rotation so that they are pushed through between the deposit elements by the press-on element. As a result, a particularly simple and robust structure of the device is made possible.

It is particularly advantageous when the device includes a counter-pressure unit which dependent on the movement of the press-on element is movable in deposit direction with the aid of the control unit. As a result, a reliable deposit of the notes of value is made possible in that the notes of value already received in the deposit area are held in the stacked form.

Various aspects will become apparent to those skilled in the art from the following detailed description and the accompanying drawings.

DETAILED DESCRIPTION

Figure 1:
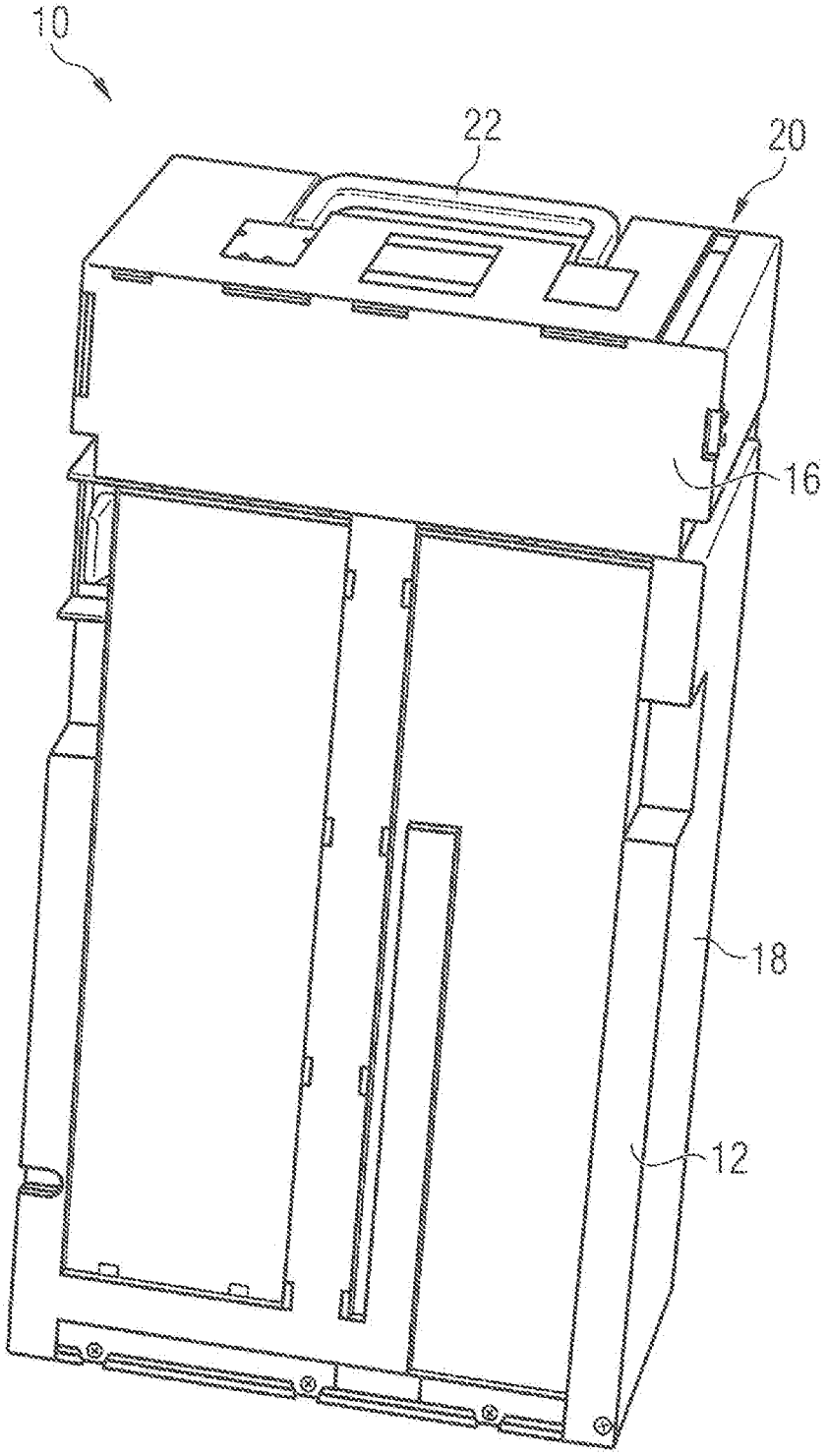
FIG. 1 shows a perspective illustration of a cash box in an operating position.

Referring now to the drawings, FIG. 1 shows a perspective illustration of a cash box 10 in an operating position. In the operating position, notes of value can be received in the cash box 10 on a horizontal value note stack. This operating position is also referred to as a vertical or standing position. The cash box 10 has a housing 12 with several lids, of which in FIG. 1 two lids 16 and 18 are visible. Further, the cash box 10 includes a handle 22 for an easy transport of the cash box 10 and a feeding slot 20 for feeding non-illustrated notes of value. In the operating position of the cash box 10 shown in FIG. 1, the cash box is in this embodiment inserted in a device for handling notes of value, such as an automated teller machine or an automatic cash safe or an automatic cash register system for feeding and/or removing notes of value into or from the cash box, respectively.

Figure 2:
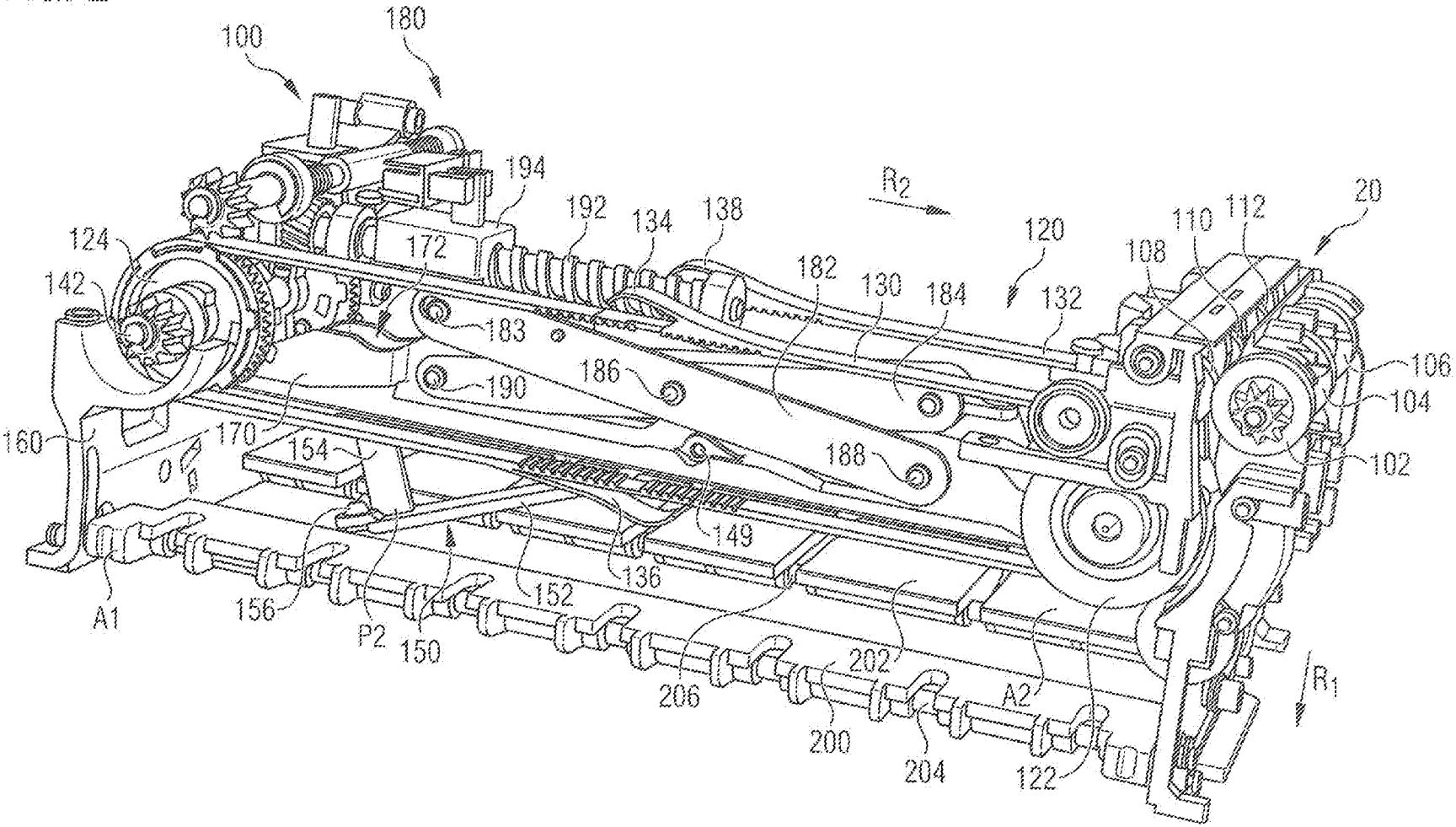
FIG. 2 shows a perspective view of a device for stacking notes of value, which is provided in the cash box of FIG. 1.

FIG. 2 shows a perspective view of a device 100 for stacking notes of value, which is provided in the upper part of the housing 12 in the cash box 10 according to FIG. 1. The notes of value are fed to the device 100 via the feeding slot 20. With the aid of transport rollers 102 to 106, which are drivable via a non-illustrated drive unit, and of press-on rollers 108 to 112 arranged opposite to the transport rollers the notes of value are guided past a non-illustrated detection unit for detecting the front edge of the notes of value and are fed to a stacking belt arrangement 120. The detection unit includes a detecting element which generates a sensor signal that is transferred to a non-illustrated control unit and is evaluated by the control unit.

The stacking belt arrangement 120 includes four deflecting rollers of the type of a pulley, of which in FIG. 2 two deflecting rollers 122 and 124 are visible. A first circulating stacking belt 130 is guided over the deflecting rollers 122, 124, the deflecting roller 124 being connected to a drive shaft 142 in a rotationally fixed manner. The drive shaft 142 is drivable with the aid of a non-illustrated drive unit. A second circulating stacking belt 132 is guided over two deflecting rollers not visible in the illustration according to FIG. 2, where one of the two deflecting rollers is connected to the drive shaft 142 in a rotationally fixed manner. In sections, the inside of the stacking belts 130, 132 has a toothing, similar to a toothed belt, which engages with a complementary toothing of the deflecting rollers 124 connected to the drive shaft 142. As a result, a positive connection of the stacking belts 130, 132 and the deflecting rollers 124 is established so that slip between the stacking belts 130, 132 and the deflecting rollers 124 is prevented.

Further, each of the stacking belts 130, 132 includes two transport tongues, of which in FIG. 2 the transport tongues having the reference signs 134 to 138 are visible. The first transport tongue 134 of the first stacking belt 130 and the first transport tongue 138 of the second stacking belt 132 are arranged at the same height orthogonally to a circulating direction R2 of the stacking belts 130, 132, the second transport tongue 136 of the first stacking belt 130 and the second transport tongue of the second stacking belt 132, not visible in the illustration of FIG. 2, are likewise arranged at the same height orthogonally to the circulating direction R2 of the stacking belts 130, 132.

When a note of value is fed to the stacking belt arrangement 120, a non-illustrated control unit controls the drive unit for driving the transport belts 130, 132 such that the first transport tongues 134, 138 or the second transport tongues 136 form by the deflection at the deflecting rollers 122 facing the feeding slot 20 together with the circumferential surfaces of the stacking belts 130, 132 a respective open feed gap. A front area of the note of value fed to the stacking unit 120 is received in this feed gap. By the movement of the stacking belts 130, 132 the feed gaps are subsequently closed, and the notes of value are clamped in the first transport tongues 134, 138 or in the second transport tongues 136.

Figure 5:
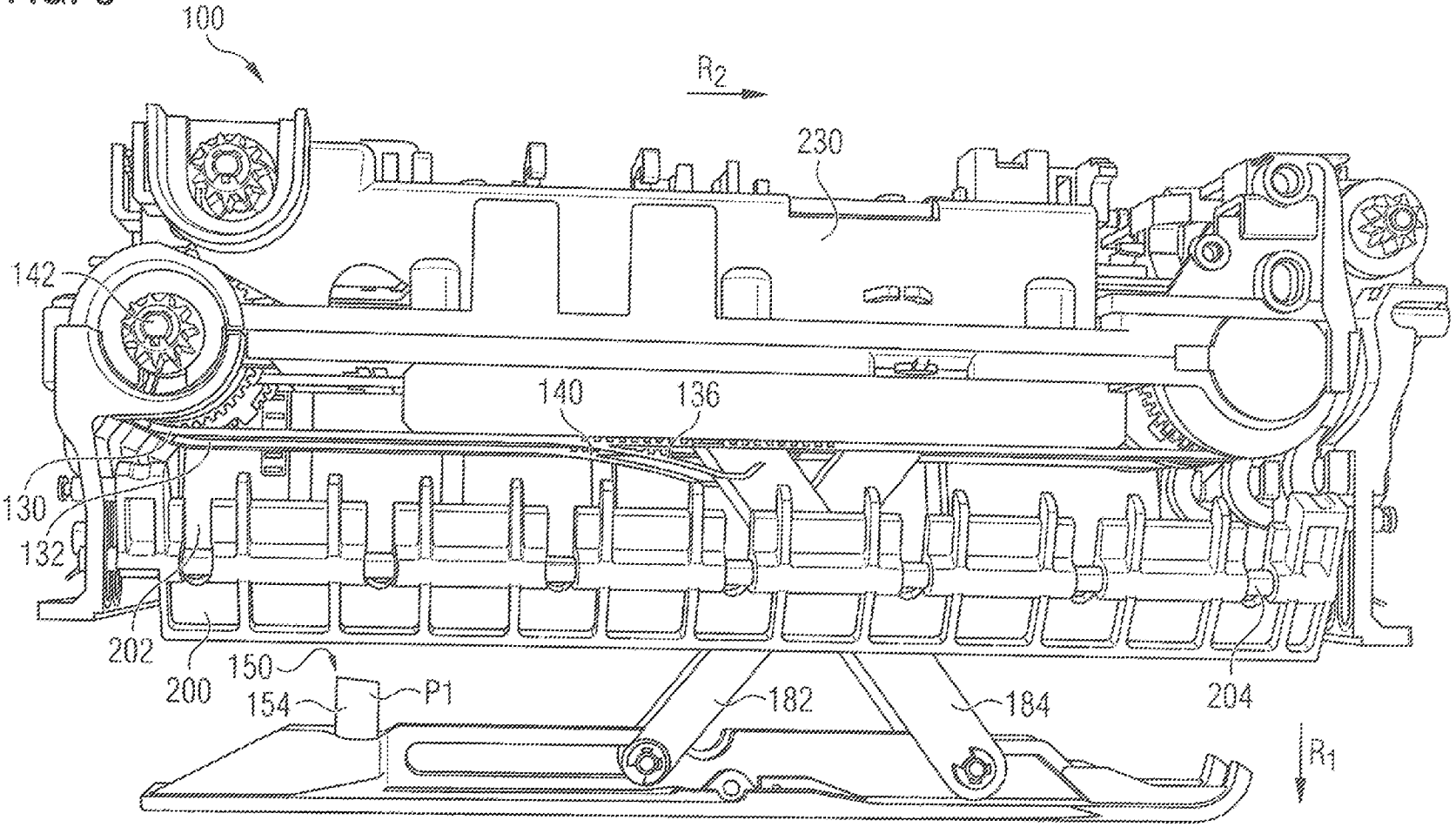
FIG. 5 is a perspective illustration of the device for feeding notes of value according to FIGS. 2 to 4*d* in a second operating state.

Further, the device 100 includes a contact element 150 which is connected to a press-on element 170 so as to be pivotable about an axis of rotation 149. The contact element 150 includes a lever arm 152 and an interrupter element 154, where the lever arm 152 has a length between 7 cm and 9 cm, in particular between 7.5 cm and 8.5 cm, for example 8 cm, and the interrupter element 154 has a length between 1 cm and 3 cm, in particular between 1.5 cm and 2.5 cm. When a note of value received in the transport tongues 134 to 138 is guided past the contact element 150, the contact element 150 is moved against gravity from the swiveled-away position P2 illustrated in FIG. 2 in the direction of the press-on element 170 into a swiveled-on position P1, the interrupter element 154 being moved into a recess 172 of the press-on element 170. In FIG. 5, the contact element 150 is illustrated in the swiveled-on position P1.

A light barrier that is not visible in FIG. 2 is arranged in the recess 172. The light barrier includes an optical sender for emitting light and an optical receiver for receiving the light emitted by the sender. The sender and the receiver are arranged such that upon passage of the interrupter element 154 between the optical sender and the optical receiver the light beam emitted by the sender is interrupted. This interruption is detected by the receiver. The receiver generates a sensor signal which is transmitted to the control unit and is evaluated by the control unit.

The note of value remains in the first or second transport tongues 134 to 138 until these are deflected at the deflecting rollers 124 connected to the driven shaft 142. Upon deflection, the feed gaps are opened, and the note of value is released. The note of value still present in the transport tongues 134 to 138 is stopped at a strip-off element 160. The transport tongues 134 to 138 are moved further by means of the belts so that the notes of value are removed from the transport tongues 134 to 138. The removal from the transport tongues 134 to 138 causes that the note of value falls down and thus moves in a deposit direction R1. Further, the note of value removed from the transport tongues 134 to 138 no longer holds the contact element 150 in the swiveled-on position P1 so that the contact element 150 due to gravity moves in the direction of the swiveled-away position P2 and thus likewise in the deposit direction R1 and in doing so contacts the note of value until it lands on an already deposited value note stack or on deposit elements 200, 202.

The deposit element 200 is pivotably mounted about an axis of rotation 204, the deposit element 202 is pivotably mounted about an axis of rotation 206. In the illustration according to FIG. 2, the deposit elements 200, 202 are each oriented in a deposit position A1, A2 in which notes of value can be deposited on the deposit elements 200, 202. The distance between the stacking belts 130, 132 and the deposit elements 200, 202 in their deposit position A1, A2 or the distance between the stacking belts 130, 132 and the value note stack already deposited on the deposit elements 200, 202 defines a free space into which further notes of value can be fed and stacked.

Based on a first sensor signal of the optical receiver in the recess 172 and on a second sensor signal of the detection unit in the feeding area of the notes of value, the control unit determines whether the free space is sufficiently large so that further notes of value can be stacked. When the contact element 150 is in the swiveled-on position P1 and when no note of value has been fed to the device 100, then the control unit detects that the contact element 150 has been lifted from the already deposited notes of value into the swiveled-on position P1 and that no further notes of value can be stacked in the free space. Based thereon, the control unit controls a non-illustrated drive unit which moves the press-on element 170 in the deposit direction R1 by a predetermined distance until the device 100 has reached a second operating state. The second operating state is described in the following in connection with FIG. 5.

The lever arm 152 of the contact element 150 includes a friction element 156 that is configured and arranged such that it contacts the note of value when the note of value removed from the transport tongue 130 to 136 moves in deposit direction R1, and the contact element 150 is pivoted by an angle between 0.5° and 3°, in particularly between 1° and 2°, for example by 1.5°, in deposit direction from the swiveled-on position P1. The friction element 156 is for example a plastic or rubber buffer, which shortens or prevents a movement opposite to the feed direction of the notes of value after removal from the transport tongues 130 to 136, as a result whereof a clean and orderly deposit of the notes of value as a value note stack on the deposit elements 200, 202 is achieved.

The press-on element 170 is movable in the deposit direction R1 and opposite to the deposit direction R1 by a gear arrangement 180 drivable by a non-illustrated drive unit. A movable slide 194 connected to the gear arrangement 180 is connected to a first scissors lever 182 via a shaft 183. The first scissors lever 182 is connected to a second scissors lever 184 via a shaft 186. The scissors levers 182, 184 are engaged with the press-on element 170 via a respective shaft 188, 190. By way of the non-illustrated drive unit and the gear arrangement 180 the movable slide 194 can be moved from the position illustrated in FIG. 2 along a worm shaft 192 in the direction R2 and in a direction opposite to the direction R2. During the movement of the movable slide 194 in the direction R2, the scissors levers 182, 184 are forced apart, as a result whereof a movement of the press-on element 170 in the deposit direction R1 is caused.

Figure 3:
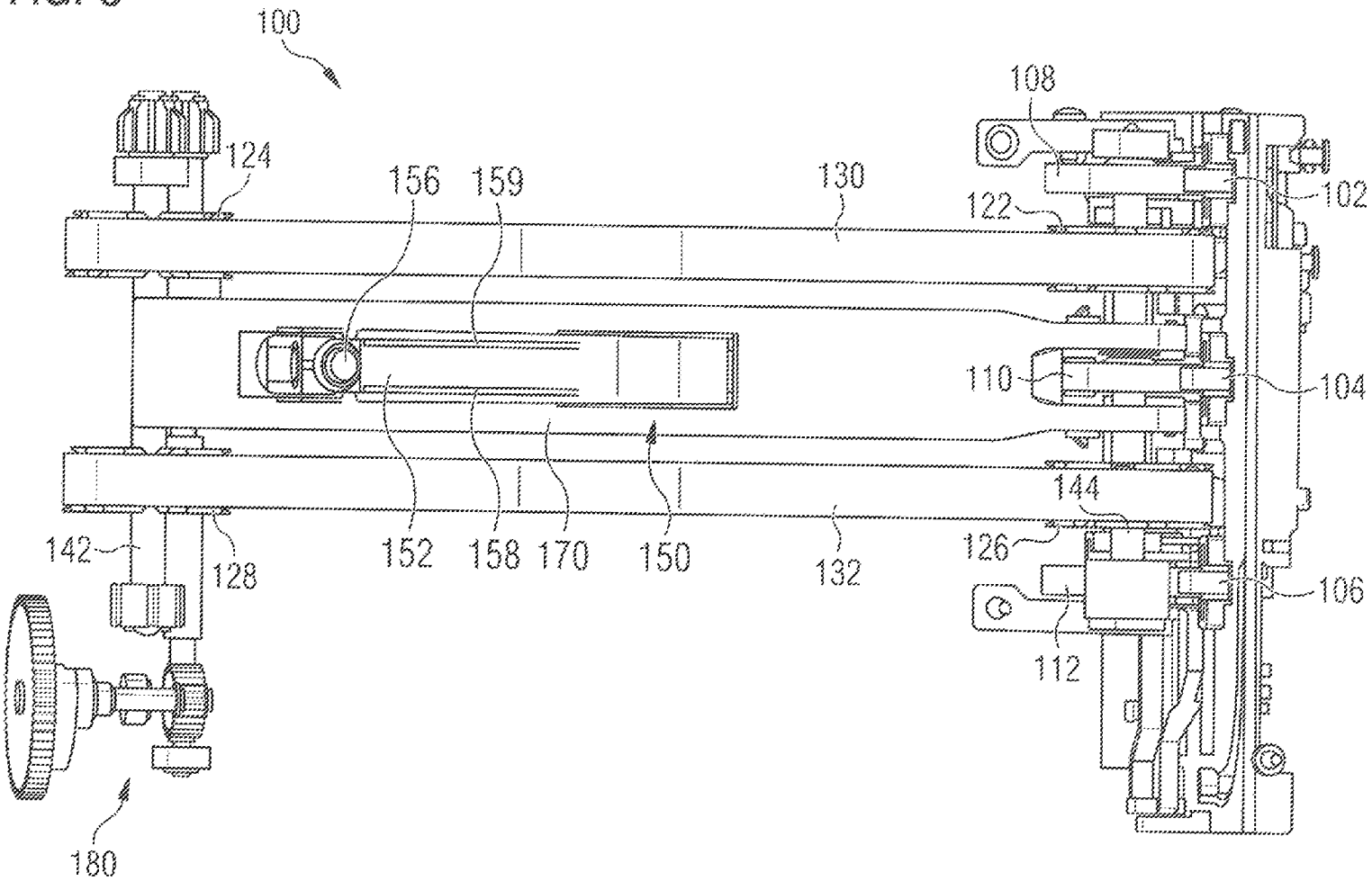
FIG. 3 is a view from below of a detail of the device for feeding notes of value according to FIG. 2.

FIG. 3 shows a view from below of a detail of the device 100 for feeding notes of value according to FIG. 2. Elements having the same structure, or the same function are identified with the same reference signs. In the illustration of FIG. 3, the deflecting rollers 126 and 128 via which the stacking belt 132 is guided are visible. Further, a non-driven shaft 144 is visible with which the deflecting rollers 122 and 124 are connected in a rotationally fixed manner. On its side facing the value note stack or the deposit elements 200, 202, the lever arm 152 has two sliding elements 158, 159 of the type of two longitudinal ribs. These cause that the note of value is not hindered in its movement by the contact element 150 when guided past the contact element 150, and not be slowed down or adheres to the contact element 150.

Figure 4A:
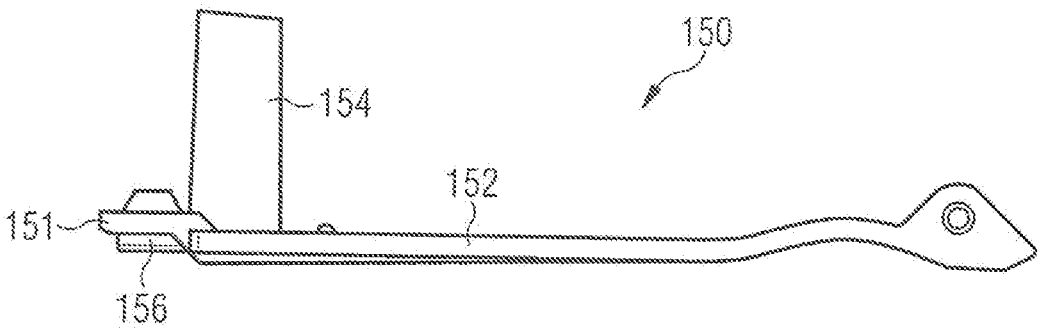
FIG. 4*a* is a side view of a contact element of the device according to FIG. 3.
Figure 4B:
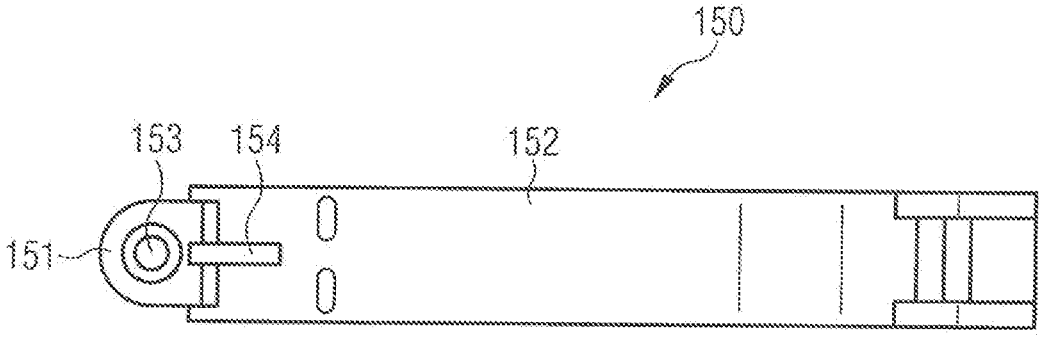
FIG. 4*b* is a top view of the contact element according to FIG. 4*a*.
Figure 4C:
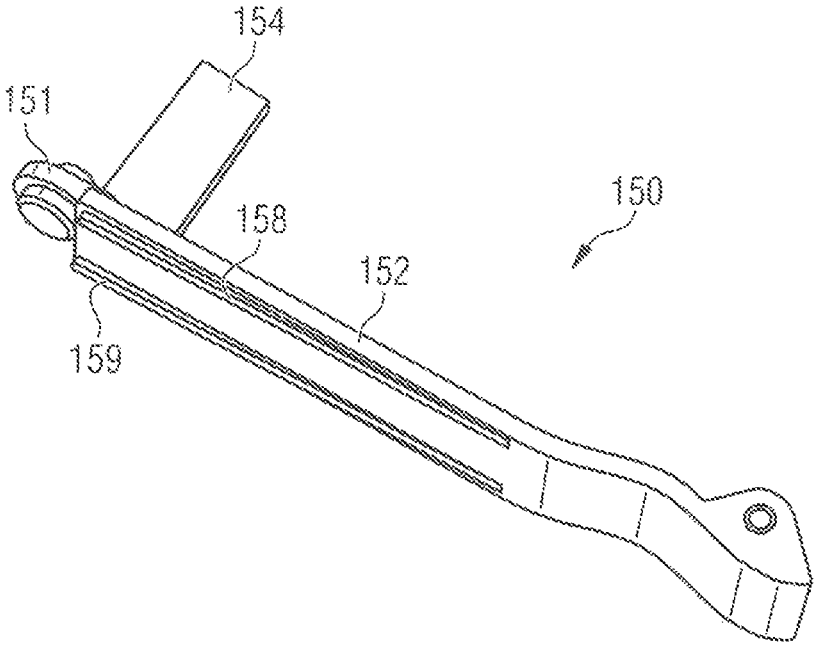
FIG. 4*c* is a perspective view of the contact element according to FIGS. 4*a* and 4*b*.
Figure 4D:
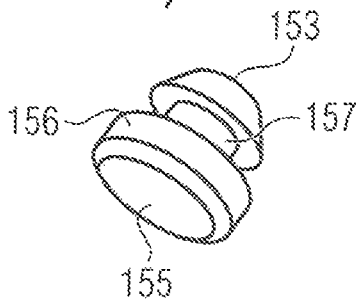
FIG. 4*d* is a perspective view of a friction element of the contact element according to FIGS. 4*a* to 4*c*.

FIG. 4*a* shows a side view of the contact element 150, FIG. 4*b* shows a top view of the contact element 150, FIG. 4*c* shows a perspective view of the contact element 150, and FIG. 4*d* shows a perspective view of the friction element 156. The friction element 156 in particular has a cylindrical basic shape with a surface 155 facing the value note stack or the deposit elements 200, 202, having a radius between 1.5 mm and 4 mm, for example between 2 mm and 3 mm, in particular of 2.5 mm. The connection of the friction element 156 to the contact element 150 is established via an engagement element 157 firmly connected to the friction element, into which engagement element a holding element 151 of the lever arm 152 engages. On its side facing away from the friction element 156, the engagement element 157 is connected to a cover element 153 which has a frusto-conical shape. The engagement element 157 in particular has a radius between 0.5 mm and 3 mm, for example between 1 mm and 2 mm, in particular of 1.6 mm.

The friction element 156 is offset with respect to the sliding elements 158, 159 of the lever arm 152 by a distance between 0.1 mm and 0.5 mm in the direction of the interrupter element 154, arranged in the shadow of the lever arm 152. As a result, it is achieved that the friction element 156 does not contact the note of value when the note of value presses the contact element into the swiveled-on position P1. The friction element 156 contacts the note of value only when the note of value removed from the transport tongue 134 to 138 moves in deposit direction R1 and the contact element 150 is pivoted by an angle between 0.5° and 3°, in particular by 1°, in the deposit direction R1.

By the contact between the note of value and the friction element 156 during the movement of the note of value in the deposit direction R1, it is achieved that the note of value is pressed against the notes of value already deposited as a value note stack or against the deposit elements 200, 202 beyond its own weight, without sticking or adhering to the contact element 150. Further, after deposit, the note of value is reliably held on the deposit elements 200, 202 or on the value note stack present thereat until a further note of value is fed to the device 100 and presses the contact element 150 into the swiveled-on position P1 against gravity.

FIG. 5 shows a perspective illustration of the device 100 for feeding notes of value according to FIGS. 2 to 4*d* in a second operating state. In the illustration according to FIG. 5, the upper region of the device 100 is covered by a housing 230. In the illustration according to FIG. 5, the second transport tongue 140 of the stacking belt 132 is visible. In the second operating state, the press-on element 170 has been moved in the deposit direction R1 by a non-illustrated drive unit controlled by the control unit, after the control unit has determined based on the first sensor signal and on the second sensor signal that no further notes of value can be deposited in the free space. Upon movement of the press-on element 170, the value note stack deposited on the deposit elements 200, 202 is pushed through the deposit elements 200, 202, which had simultaneously been pivoted about the axes of rotation 204, 206.

Figure 6:
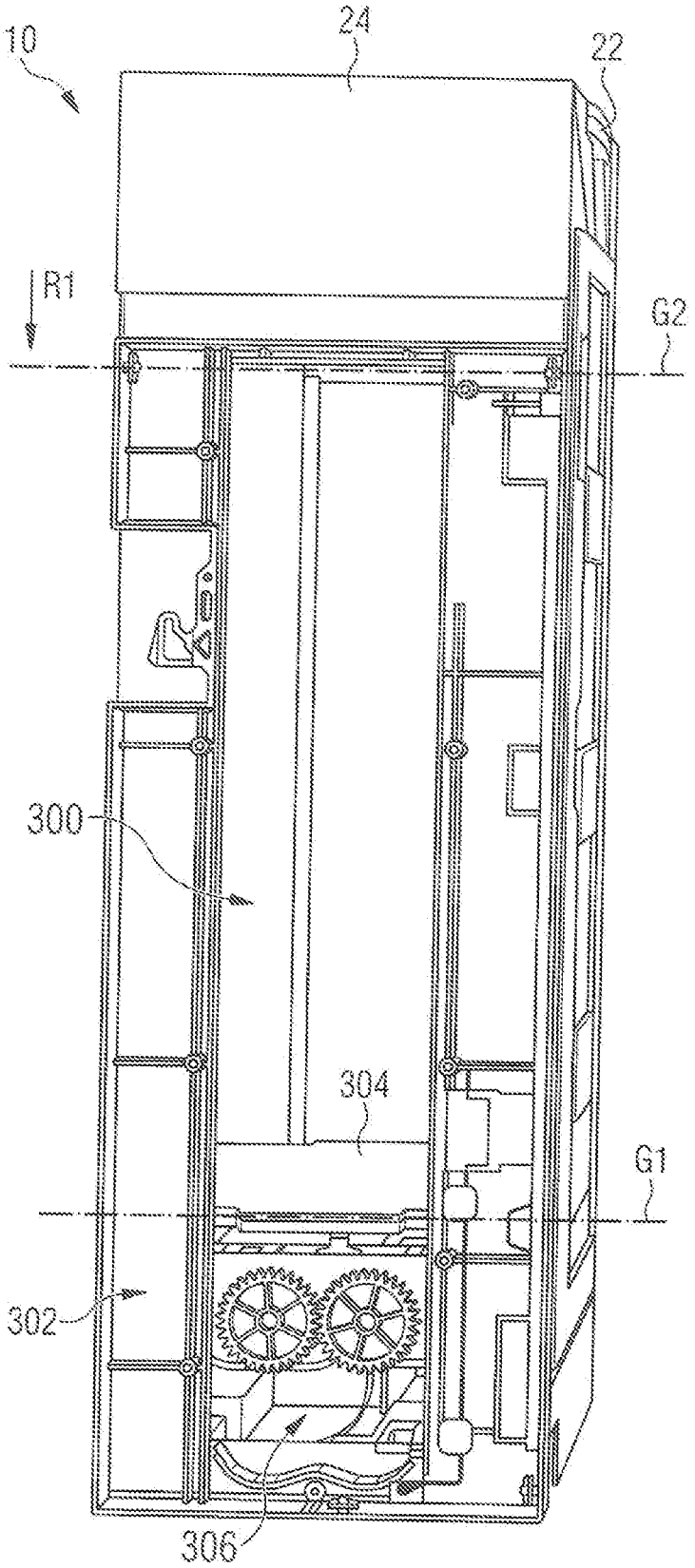
FIG. 6 is a perspective illustration of a detail of the internal structure of the cash box according to FIG. 1.

FIG. 6 shows a perspective illustration of a detail of the internal structure of the cash box 10 according to FIG. 1. The apparatus 100 is covered in the upper region of the cash box 10 by a lid 24, whereas the internal structure of a storage area 300 of the cash box 10 is visible. The storage area 300 is delimited by a counter-pressure unit 302 including a movable counter-pressure surface 304 and a gear arrangement 306.

In FIG. 6, the counter-pressure unit 304 is illustrated in a first operating position in which the counter-pressure unit 302 is arranged at a first position G1 indicated by a first line, where the volume of the storage area 300 is maximum at this first position G1. With the aid of a non-illustrated drive unit the counter-pressure unit 302 can be moved opposite to the deposit direction R1 and in deposit direction R1 between the position G1 and a second position G2 indicated by a second line. When the counter-pressure unit 302 is arranged at the position G2, the volume of the storage area 300 is minimum.

When the notes of value are pushed through the deposit surfaces 200, 202, they are deposited on the counter-pressure surface 302 or on notes of value already deposited on the counter-pressure surface 302. A non-illustrated control unit controls the drive unit such that the movement of the counter-pressure element 302 is caused dependent on the movement of the press-on element 170.

In at least one alternative embodiment, no deposit elements 200, 202 are be provided. Further, alternative embodiments are also possible, in which no press-on element 170 and/or in which no friction element 156 is provided. In other alternative embodiments, an elastically deformable element, for example a spring or an elastomer block may be provided, which exerts a force on the contact element 150 in the direction of the value note stack.

While principles and modes of operation have been explained and illustrated with regard to particular embodiments, it must be understood, however, that this may be practiced otherwise than as specifically explained and illustrated without departing from its spirit or scope.

What is claimed is:

1. A device for stacking notes of value, comprising:

at least one circulating belt arrangement including an endless belt guided over rollers for serving as deflecting elements, where a circumferential surface of the endless belt includes at least one transport tongue into which at least a section of a note of value is insertable, at least one strip-off element for contacting the note of value for removal from the transport tongue to, after removal from the transport tongue, move the note of value in a deposit direction until the note reaches a deposit surface or until it reaches an upper note of value of a value note stack present on the deposit surface, and a contact element arranged and configured such that during the transport in the transport tongue the note of value moves the contact element into a first position, and the contact element contacts an area of the note of value at least after the removal of the note of value from the transport tongue up to the arrival of the note of value on the deposit surface or on the upper note of value of a value note stack deposited on the deposit surface.

2. The device according to claim 1, where after the removal of the note of value from the transport tongue, up to the arrival of the note of value on the deposit surface or on the upper note of value of the value note stack, the contact element and the note of value move in the deposit direction with the aid of gravity.

3. The device according to claim 1, where the contact element is pivotably mounted about an axis of rotation and that the contact element is pivotable by an angle between 15° and 30°, from the first position in the deposit direction and opposite to the deposit direction.

4. The device according to claim 3, where the contact element is pivotable by an angle of 20°.

5. The device according to claim 4, where the contact element is pivoted by an angle of 1° in deposit direction.

6. The device according to claim 5, where the notes of value can be deposited on the first deposit element and on the second deposit element when the first deposit element and the second deposit element are in non-pivoted deposit positions, and that the distance between the transport tongues and the non-pivoted deposited elements, or the transport tongues and the notes of value deposited on the first and on the second deposit element defines a free space.

7. The device according to claim 1, where the contact element includes at least one friction element configured and arranged such that the friction element contacts the note of value when the note of value removed from the transport tongue moves in the deposit direction, and the contact element is pivoted by an angle between 0.5° and 3° in deposit direction.

8. The device according to claim 7, where the at least one sliding element is a longitudinal rib.

9. The device according to claim 8, where the first sensor unit includes a first detecting element, where the first detecting element generates the first sensor signal and transfers it to the control unit.

10. The device according to claim 9, where the contact element is connected to the press-on element so as to be pivotable about an axis of rotation.

11. The device according to claim 9, where the control unit determines, based on the first sensor signal and the second sensor signal, whether notes of value can be stacked in the free space and that the control unit moves the press-on element by a predetermined distance in the deposit direction as soon as it determines based on the first sensor signal and/or the second sensor signal that no further notes of value can be stacked in the free space.

12. The device according to claim 9, where the device further comprises a counter-pressure unit which dependent on the movement of the press-on element is movable in the deposit direction with the aid of the control unit.

13. The device according to claim 8, where the device further comprises at least a second sensor unit comprising a second detecting element, where the second sensor unit outputs a second sensor signal when the second detecting element detects an edge of the note of value in a feeding area of the device.

14. The device according to claim 13, where the notes of value during the movement of the press-on element in the deposit direction pivot the deposit elements about their axes of rotation so that they are pushed through between the deposit elements by the press-on element.

15. The device according to claim 8, where the device further comprises at least a press-on element, and a drive unit for driving the press-on element being controllable with the aid of the control unit such that the drive unit moves the press-on element in the deposit direction.

16. The device according to claim 1, where the contact element includes at least one sliding element.

17. The device according to claim 1, where the deposit surface includes a first deposit element and a second deposit element, on which the note of value or the value note stack rests, each of the first and second deposit elements being pivotable about an axis of rotation parallel to a respective longitudinal axis of each of the first and second deposit elements.

18. The device according to claim 17, where the first detecting element is a light barrier or a double light barrier.

19. The device according to claim 1, where the device further comprises at least one control unit and at least a first sensor unit, where the first sensor unit outputs a first sensor signal dependent on the position of the contact element and that a feeding of the note of value into the device is at least not possible when the contact element is in the first position.

* * * * *